US005700963A

United States Patent [19]

Koelemeijer et al.

[11] Patent Number: 5,700,963

[45] Date of Patent: Dec. 23, 1997

[54] MUSIC BOX MOVEMENT WITH DETENT STOP

[75] Inventors: Alexandra Koelemeijer; Bernard Knuchel, both of Yverdon-les-Bains, Switzerland; Laurent Letoublon, Malbuisson, France; Stéphane Olgiati, Renens, Switzerland

[73] Assignee: Reuge Music USA Ltd., Los Angeles, Calif.

[21] Appl. No.: 699,682

[22] Filed: Aug. 14, 1996

Related U.S. Application Data

[63] Continuation of Ser. No. 367,210, filed as PCT/CH94/00084, May 5, 1994, abandoned.

[30] Foreign Application Priority Data

May 17, 1993 [FR] France ..... 93 06090

[51] Int. Cl.[6] ..... G10F 1/06

[52] U.S. Cl. ..... 84/95.1

[58] Field of Search ..... 84/95.1, 95.2, 84/94.1, 94.2; D12/24

[56] References Cited

U.S. PATENT DOCUMENTS

| | | | |
|---|---|---|---|
| 3,149,525 | 9/1964 | Marder | 84/95.1 |
| 4,554,856 | 11/1985 | Esaki | 84/95.2 |

FOREIGN PATENT DOCUMENTS

| | | |
|---|---|---|
| 1 007 154 | 4/1957 | Germany . |
| 1 083 630 | 6/1960 | Germany . |
| 212653 | 3/1941 | Switzerland . |
| 323641 | 9/1957 | Switzerland . |

*Primary Examiner*—Cassandra C. Spyrou
*Attorney, Agent, or Firm*—Davis and Bujold

[57] ABSTRACT

A movement for a musical box comprising a base plate (11) supporting a roller (13) which has a plurality of radial pins (14) arranged to actuate a plurality of reeds (15) of a musical keyboard (16). The roller (13) is driven by a drive mechanism (12) via a movement train (17). A detent stop (18) is provided for preventing, as desired, movement of the roller. The detent stop has a support which is either force fitted or resiliently attached to the music box without disturbing the alignment between the musical keyboard and the roller.

15 Claims, 8 Drawing Sheets

MUSIC BOX MOVEMENT WITH DETENT STOP

This application is a continuation of application Ser. No. 08/367,210, filed as PCT/CH94/00084 May 5, 1994, now abandoned.

The present invention concerns a movement comprising a cylinder with radial pins designed to vibrate the reeds of a musical keyboard mounted on a support integral with a plate, a drive mechanism for the cylinder, a movement train regulating cylinder speed and a detent designed to stop the movement.

In prior art music box movements the detent may consist of a slidable rod passing through the plate and cooperating with a recall spring, with the unit being attached directly by the head of one of the screws which attaches the musical keyboard, or of a pivoting element mounted directly beneath the head of one of those screws. These elements can be displaced from the resting position, in which they extend beyond the trajectory of the blade of the movement train, into the working position, in which they intercept the trajectory of the blade in order to stop movement.

Since such known movement detents are directly or indirectly connected to the screw attaching the musical keyboard, they cannot be positioned automatically by machine, but must be manually assembled by a skilled worker. The musical keyboard, which is the most delicate part of the movement and imparts the musical quality, must be very precisely positioned. Removing it afterwards in order to attach the detent is not only a risky, long and delicate operation, but also a costly one.

The instant invention proposes overcoming this disadvantage by providing a detent which can be attached automatically if desired, and more precisely, can be positioned independently of the other components of the movement.

To achieve this goal, the movement according to the invention is characterized in that said detent comprises support means with rapid assembly elements, for either force-fitting or resilient snap-mounting to at least one fixed element integral with the plate.

Said support means advantageously includes a bracket, and said rapid assembly means comprise a base of the same shape and size as an opening in the musical keyboard support such that forcing the base into said opening results in a rigid friction connection between said support means and said support.

In a first variation of the invention said detent has an articulated crank-like rod on the bracket and said rod has one extremity which intersects the trajectory of a blade of the movement train.

In another variation the mechanism comprises a pivoting lever, one end of which engages in an opening near the periphery of a lateral flange of the roller.

In a preferred embodiment the support means comprises a machined element and said rapid attachment means consist of two lateral footings which respectively fit underneath bearings formed in the heads of the screws attaching the musical keyboard.

In all embodiments said detent comprises either an articulated crank-like rod mounted on said machined element or a pivoting slidable lever and a recall spring, one end of which is connected to the pivoting lever and the other end of which is connected to said machined element.

If the pivoting lever is also slidable, it is held by a support integral with the base plate and which has a pin passing through an oblong opening in the lever.

Said support means advantageously comprises a spring element, one end of which is resiliently snap-mounted to the bearings on the heads of the screws attaching the musical keyboard, while the other end of said spring element directly intercepts the trajectory of a blade on the movement train.

According to other variations, the other extremity of the spring may be designed to hold a slidable counterweight which may directly intercept the trajectory of one blade or my guide an axially movable rod which directly intercepts the trajectory of one blade. Said rod may be connected to the extremity which functions as a recall spring.

In an advantageous embodiment said support means comprise a machined element consisting of a base plate and a block supporting the detent, said base plate having a notch which engages with one bearing of a screw attaching the musical keyboard, and a pin which engages in an opening in the base plate. Said block my include means for positioning several detents.

The instant invention will be more readily understood with reference to the following description of one exemplary embodiment and to the attached drawings, wherein.

Figure 1:
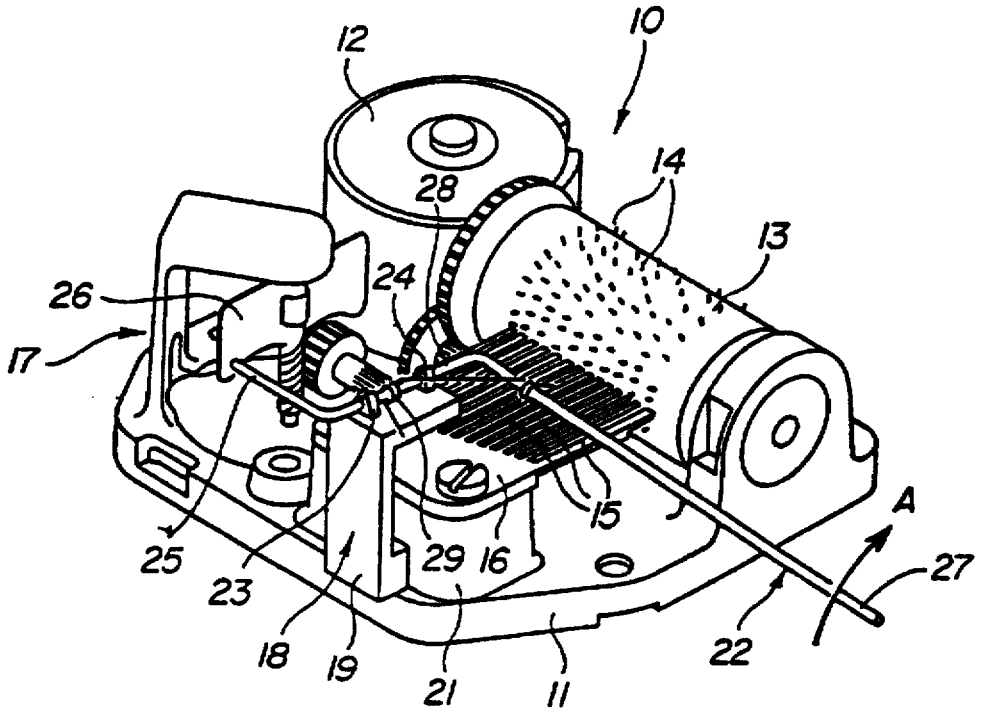
FIG. 1 is a perspective view of the movement affording to the invention illustrating a first embodiment of the detent.
Figure 2:
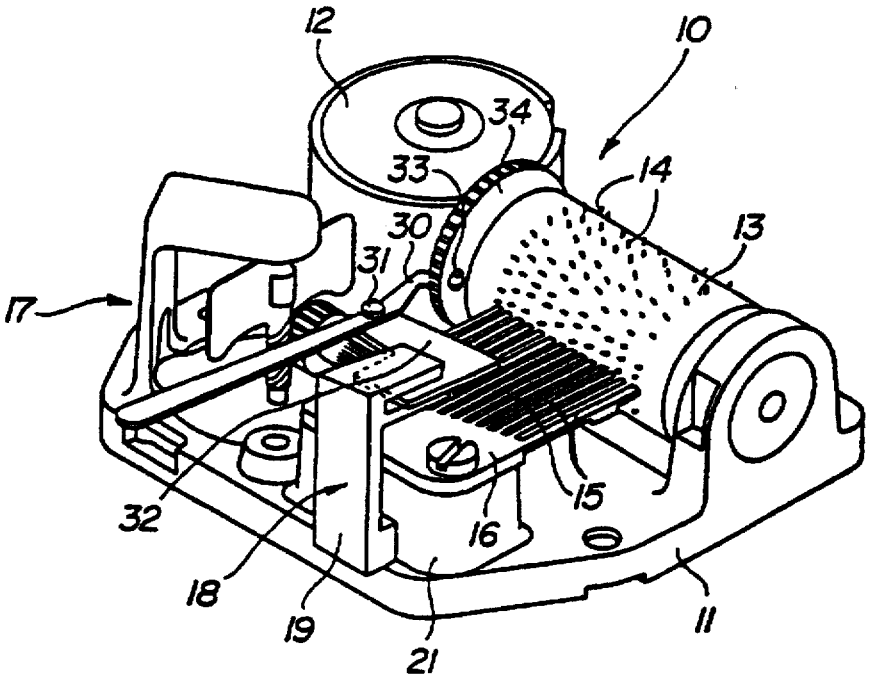
FIG. 2 is a perspective view of the movement according to the invention showing a second embodiment of the detent.
Figure 3:
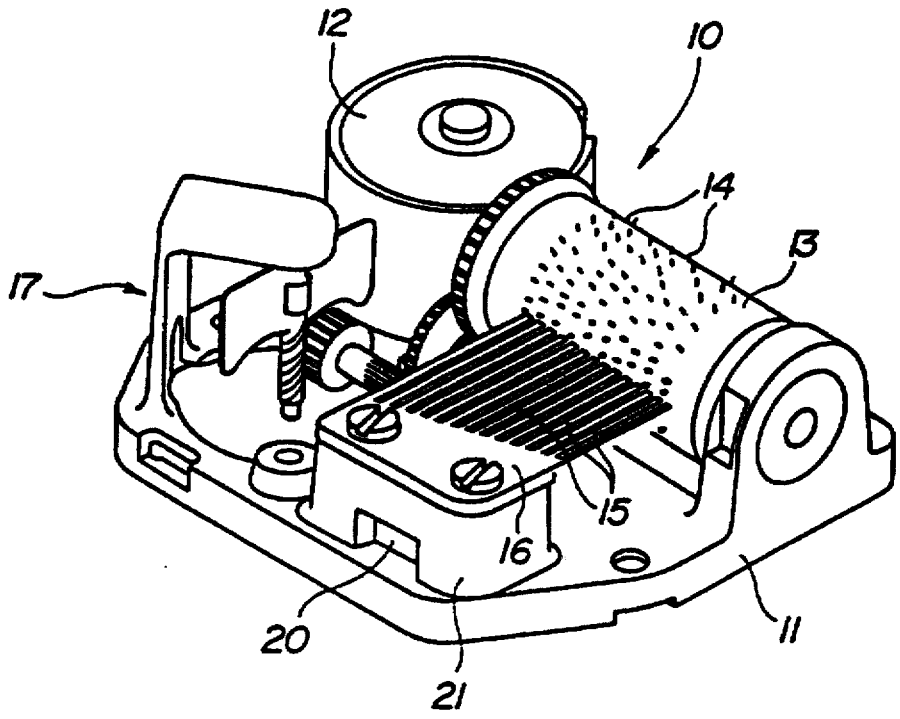
FIG. 3 shows the previously mounted base plate for the movement according to the invention before positioning the brackets supporting the detents of FIGS. 1 and 2.

With reference to FIGS. 1, 2 and 3, music box movement 10, as shown, comprises, in known manner, a base plate 11 upon which are mounted the drive mechanism 12 designed to drive roller 13 which has pins 14 designed to vibrate the reeds 15 of a musical keyboard, a movement train 17 and a detent stop 18.

FIGS. 1 and 2 show two embodiments of detent stop 18. FIG. 3 shows how the detent is attached. In these embodiments the detent is held by support means comprising a bracket 19 with a base at the bottom fitted into an opening 20 within the base plate, and more specifically, on a lateral surface of a support 21 integral with said base plate. Musical keyboard 16 is mounted on this support. In the embodiment of FIG. 1 the detent itself consists of an articulated crank-like rod 22 on two clamps 23, 24 integral with bracket 19. One end potion 25 is designed to intercept the trajectory of one blade 26 when the other end portion 27 of rod 22 is in the position shown in the drawing. When this rod is raised in the direction of Arrow A, its intermediate portion 28 pivots and end portion 25 tips downward, freeing blade 26 so the mechanism can drive the roller.

A recall spring 29, partially surrounding intermediate potion 28 and contacting bracket 19 on one side and end portion 27 on the other (it may either surround the latter or engage it with its pointed end), tends to urge rod 22 into its initial position.

In the embodiment of FIG. 2 the detent essentially comprises a lever 30 pivoting on a vertical axle 31 mounted on a plate 32 supported by bracket 19 or by an extension of this bracket. The lever is designed to engage in an opening 33 disposed in a lateral flange 34 of roller 13, or a drive wheel on this roller near its periphery. In this position the mechanism is stopped. Pivoting the lever frees this mechanism.

Figure 4:
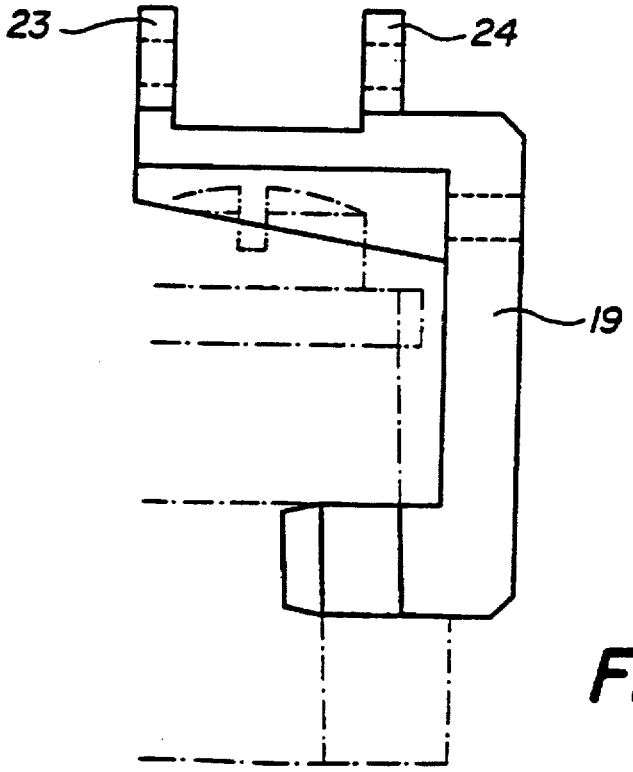
FIG. 4 is a cross-section of the bracket used in the embodiment of FIG. 1.

FIG. 4 shows bracket 19 corresponding to the embodiment of FIG. 1 having the two clamps 23 and 24 thereon.

Figure 5:
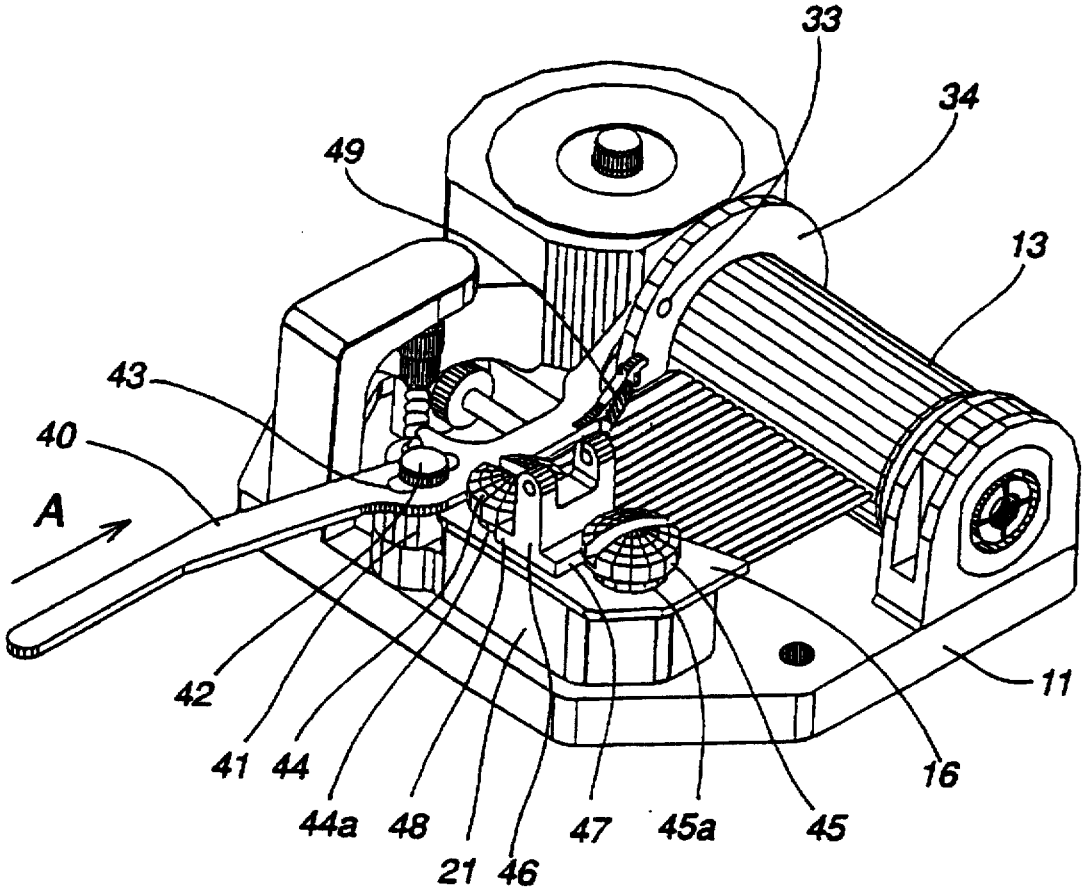
FIGS. 5, 6, 7, 8 and 9 show various embodiments of a detent for a movement according to the invention.

FIG. 5 shows another construction wherein the detent comprises a pivoting, slidable lever 40 held by a support 41 integral with base plate 11. The detent is attached to this support by a pin 42, preferably driven in, which traverses an oblong opening 43 in said lever and which has a head for maintaining it in position, with the diameter of the head being larger than the oblong opening. The lever terminates in a hook which engages in an opening 33 in the periphery of one lateral flange 34 or drive zone of roller 13.

Musical keyboard 16 is attached to support 21 by means of two screws 44 and 45, the heads of which each have a bearing 44*a*, 45*a*, respectively, or a peripheral extension formed in the lower portion of the heads. These extensions are used for attaching a machined element 46 with two lateral footings 47 and 48 which are forced between the two bearings 44*a* and 45*a*.

In the example shown machined element 46 serves as a means for attaching a recall spring 49 attached at one end to that element and at the other end, to the lever.

To stop the mechanism the lever is pushed in the direction of arrow A until the hook portion engages in opening 33. At this moment the roller stops and simultaneously, the lever tips toward rod 42, causing the blade to stop rotating.

Figure 6:
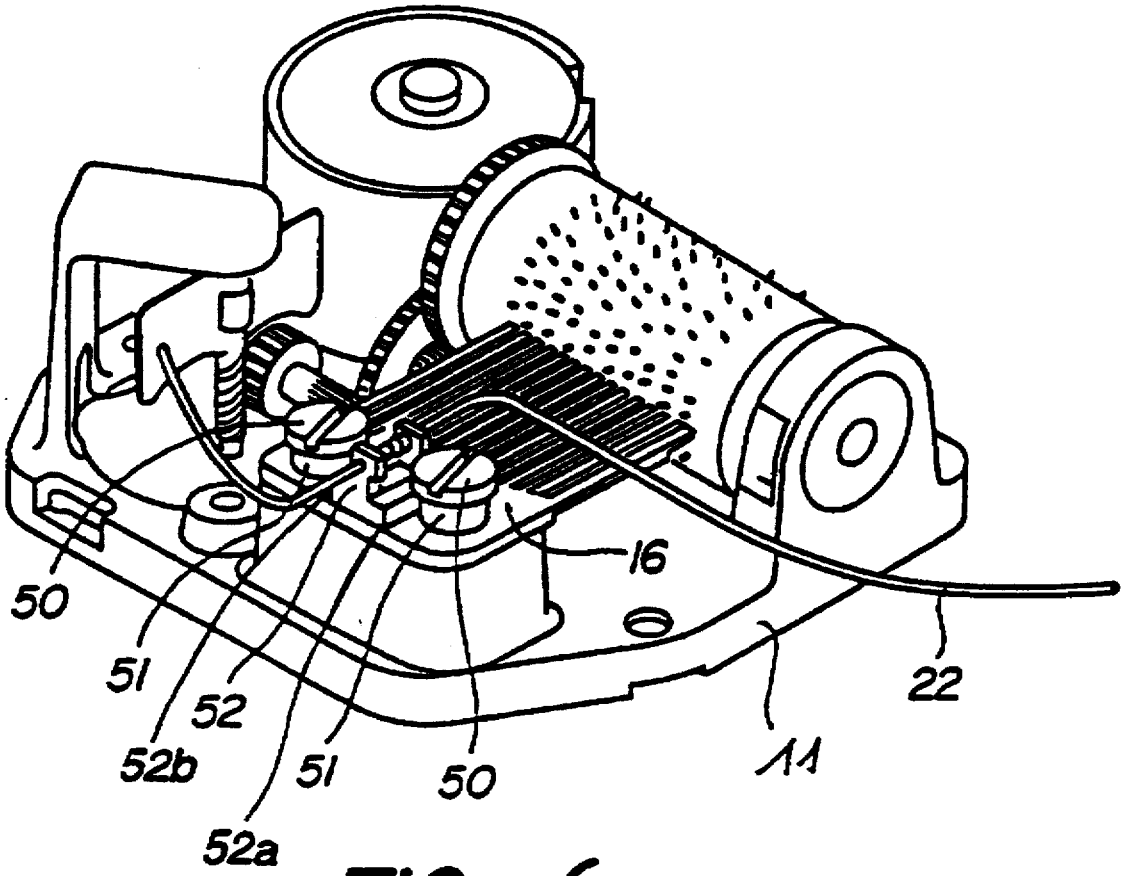

FIG. 6 shows another embodiment in which the heads of screws 50 attaching the musical keyboard 16 comprise a bearing 51. The bearing is used to attach machined element 52 forming the support for the detent and holding rod 22 which is identical, at least in function, to that shown in FIG. 1. Element 52 comprises two lateral footings 52*a*, 52*b* attached to the framework by means of the bearings 51 of the two screws 50, defining a groove which supports the base. On the broad base there are two clamps, integral with the base, traversed by rod 22. A recall spring is supported by the portion of rod 22 which is situated between the clamps that hold it. Because of this bearing, the screws assume two distinct functions: a first function consisting of attaching the musical keyboard 16, and a second consisting of attaching element 52 which supports rod 22. Both of these functions are independent, that is, the musical keyboard may be definitively mounted before element 52 is positioned. This element replaces bracket 19 of FIG. 1, thereby improving the esthetics of the movement and reducing its size. Element 52 is preferably made of synthetic material and it is attached simply by force-fitting its wide base into the groove defined by bearings 51. The screw heads serve as vertical stops for element 52 and the bearings 51 serve as lateral stops.

Figure 7:
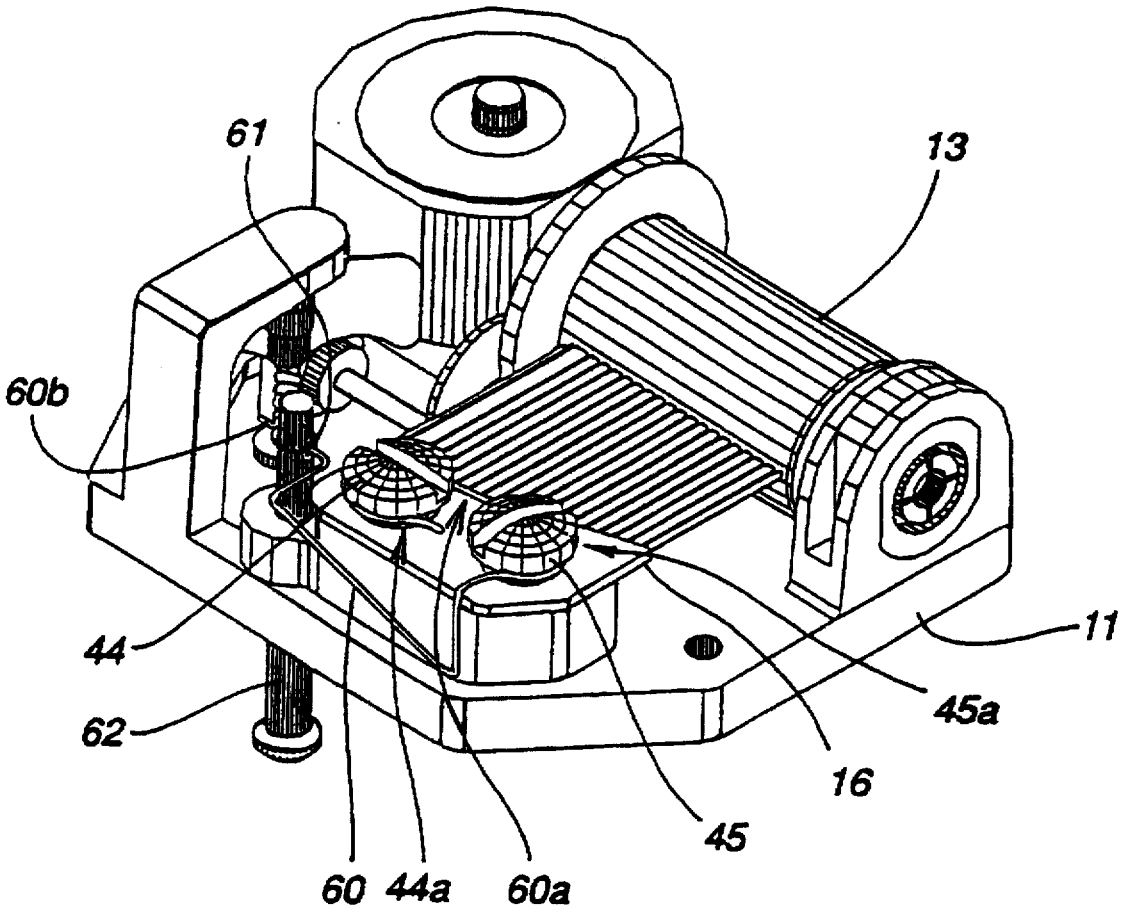

FIG. 7 shows another embodiment of a detent stop for a movement according to the invention. This detent comprises two screws 44 and 45, identical to those shown in FIG. 5, for attaching the musical keyboard 16. Bearings 44*a* and 45*a* are designed to attach a spring element 60, one end of which 60*a* is flexibly attached to these screws by engaging with the projections corresponding to these bearings, and the other end of which 60*b* traverses an opening 61 disposed in a rod 62 movable along an axis perpendicular to the base plate. The spring element 60 acts as a recall spring upon this movable rod. In the lowered position, the rod and/or the extremity of the recall element 60 do not interfere with the blade of the movement train, so that the movement can turn freely. In the raised position, the blade abuts the rod and/or the extremity of the spring element 60 so that the movement is stopped. Spring element 60 urges the rod toward the lower position.

Figure 8:
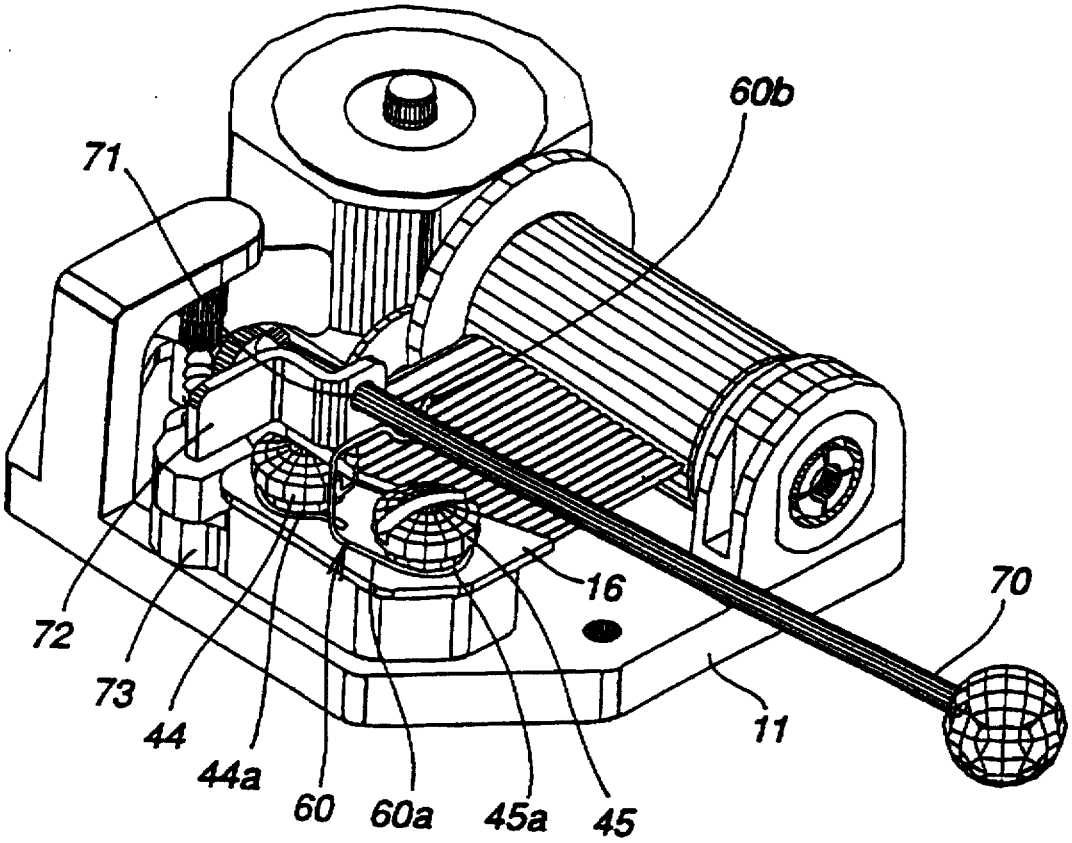

FIG. 8 shows a variation in which both the shape and the function of spring element 60 are different from the description above. The element has one extremity 60*a* which is flexibly attached to bearings 44*a* and 45*a* of screws 44 and 45. The other extremity 60*b* is designed to guide a rod 70, which is axially movable and directly intercepts the path of the blade of the movement train. This extremity may also function as a recall spring for rod 70. The latter traverses an opening 71 in an angled section 72 integral with a support 73 mounted on base plate 11.

Figure 9:
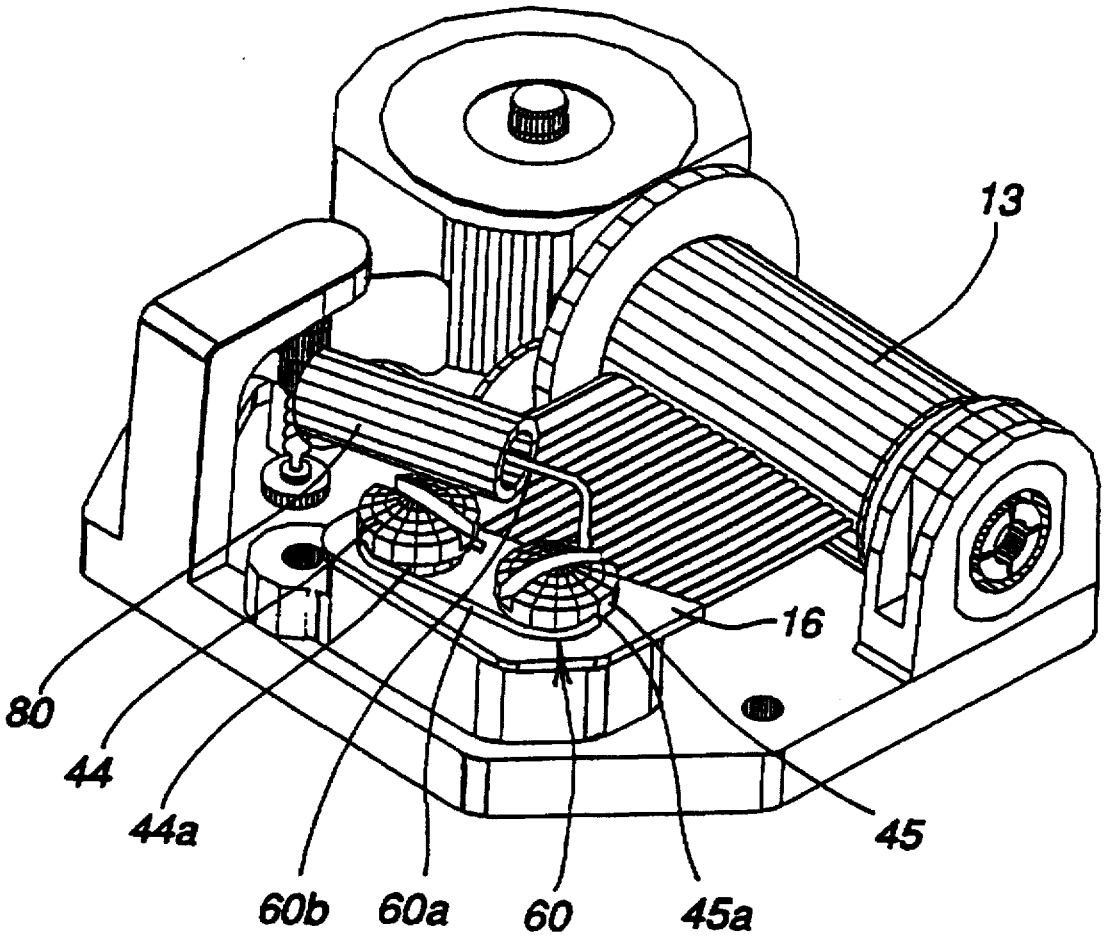

FIG. 9 represents another embodiment in which spring element 60 comprises, as before, one end 60*a* flexibly attached to bearings 44*a* and 45*a* of screws 44 and 45. The other extremity 60*b* supports a movable counterweight 80 which may assume two positions. In the first position, the counterweight does not intersect the trajectory of the blade of the movement train. In the second position, the counterweight blocks the blade and stops the movement. The counterweight is displaced between these two positions by inclining the movement in one direction or the other.

Figure 10:
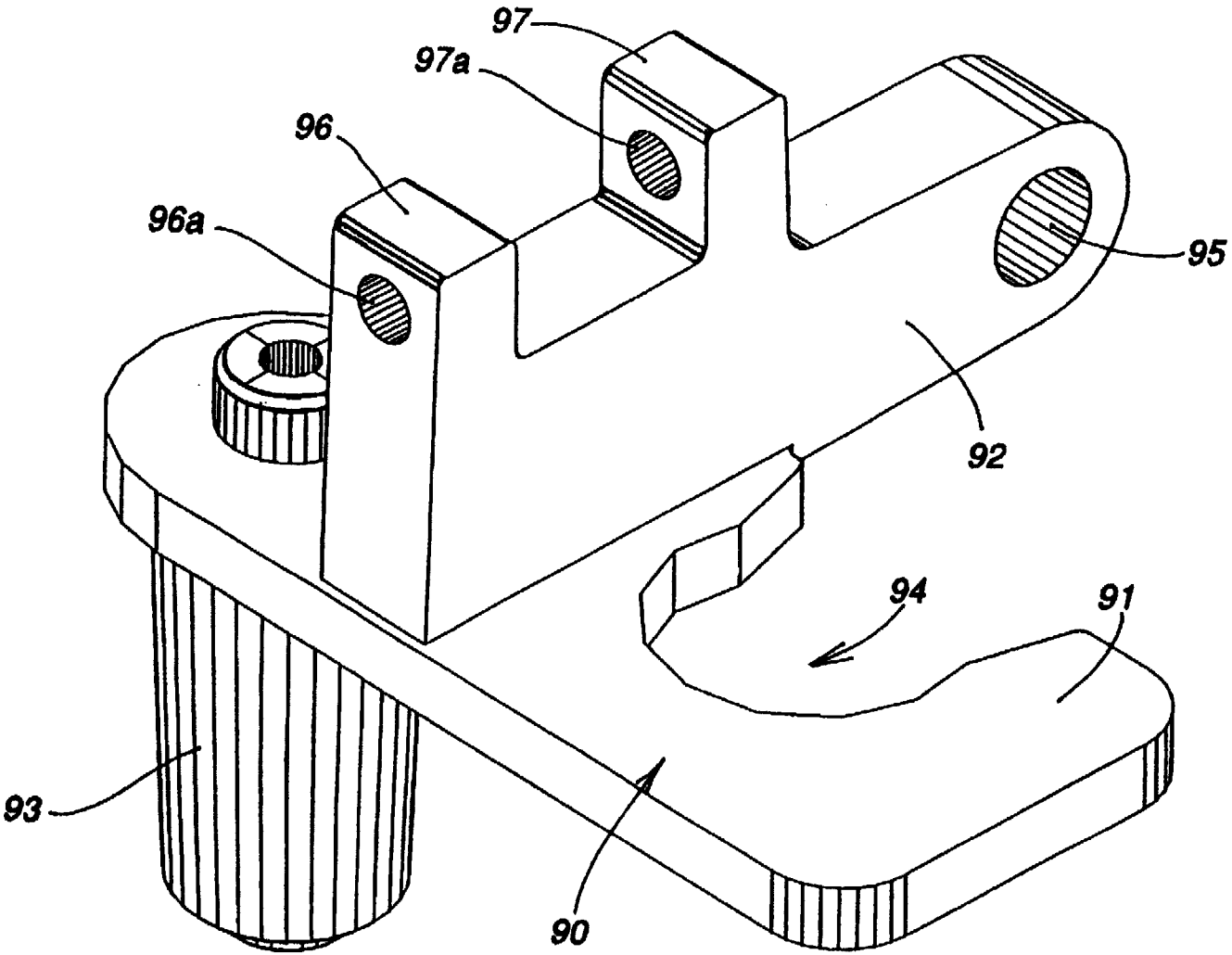
FIG. 10 is a partial illustration of a variation which combines certain constructive elements of the previously described embodiments.

FIG. 10 represents a particular embodiment of said support means. These support means consist of a machined element 90 constituting a base plate 91 and a block support 92, for the detent, attached to the base plate. In addition the base plate has a pin 93 which engages in an opening on the base plate. It also has a notch 94 which engages in the bearing of one screw, which is in fact bearing 44*a* of screw 44 of FIGS. 7 through 9.

The detent block support has various means for remounting the detent stop itself. For example, there is a transverse opening 95 for positioning rod 70 (see FIG. 8). Two crenelated portions 96 and 97, each having a transverse opening 96*a*, 97*a*, respectively, can accommodate rod 22 (see FIG. 6) or a recall spring 49 (see FIG. 5), while a slidable pivoting lever 40 (shown in the same drawing) can be mounted on pin 93.

The present invention is not limited to the embodiments described above, but extends to any modifications or variations obvious to one skilled in the art.

We claim:

1. A movement for a music box comprising a base plate (11) supporting a roller (13) having a plurality of radial pins (14), a musical keyboard (16), means for fixedly attaching and precisely positioning said keyboard (16) to said base plate (11), a plurality of reeds (15) being mounted on said keyboard and being located adjacent said roller (13) for actuation by said plurality of radial pins (14), a drive mechanism (12) being drivingly connected to said roller, a movement train (17) being coupled to said roller for regulating rotational speed of said roller, and a detent stop for stopping movement of said roller;

wherein said detent stop comprises: i) support means for supporting said detent stop, and ii) rapid assembly means for one of force-fitting and resilient snap-mounting said support means to said base plate (11) after said keyboard (16) is fixedly attached and precisely positioned to said base plate (11).

2. A movement for a music box according to claim 1, wherein said support means comprises a bracket (19), and said rapid assembly means comprise a base of said bracket (19) which has a size and shape similar to an opening (20) formed in a support (21), fixedly attaching said musical keyboard (16) to said base plate, such that force fitting of said base into said opening ensures a rigid friction coupling of said support means to said support.

3. A movement for a music box according to claim 1, wherein said detent stop (18) further includes an articulated crank-like rod (22) supported by said bracket for stopping movement of said roller (13).

4. A movement for a music box according to claim 1, wherein said movement train has a movable blade (26) and said rod (22) has one extremity which intercepts, in a first rod position, a trajectory of said blade (26).

5. The movement for a music box according to claim 1 wherein said detent stop further includes means for attaching at least one securing element integrally with said base plate (11); said means for attaching comprises a machined element (46, 52) which has two lateral footings (47, 48 and 52*a*, 52*b*) which respectively fit below bearing surfaces (44*a*, 45*a*, 51) formed in a head portion of screws (44, 45, 50) which attach said musical keyboard (16) to said base plate (11).

6. A movement for a music box according to claim 5, wherein said detent stop further comprises an articulated crank-like rod (22) mounted on said machined element for stopping movement of said roller (13).

7. A movement for a music box according to claim 5, wherein said detent stop further comprises a pivoting sliding lever (40) and a recall spring (49), and one end of said recall spring (49) is connected to said pivoting lever and a second opposed end thereof is connected to said machined element (46).

8. A movement for a music box according to claim 7, wherein said pivoting sliding lever (40) is held by a lever support (41) which is integral with said base plate (11) and holding pin (42) traverses an oblong opening (43) formed in said lever.

9. The movement for a music box according to claim 1 wherein said detent stop further includes means for attaching at least one securing element integrally with said base plate (11); said means for attaching comprises a spring element (60) which has one end (60*a*) flexibly attached to bearing surfaces (44*a*, 45*a*) formed below heads of screws (44, 45) which attach said musical keyboard (16) to said base plate (11).

10. A movement for a music box according to claim 9, wherein a second extremity (60*b*) of said spring element (60) directly intercepts, in a first spring position, a trajectory of a movable blade (26) of said movement train.

11. A movement for a music box according to claim 9, wherein a second extremity (60*b*) of said spring element (60) supports a sliding counterweight (80) which, in a first sliding position, intercepts directly a trajectory of a movable blade (26) of said movement train.

12. A movement for a music box according to claim 9, wherein a second extremity (60*b*) of said spring element (60) guides an axially moveable rod (70) which directly intercepts, in a first rod position, a trajectory of one blade (26) of said movement train.

13. A movement for a music box according to claim 12, wherein said axially moveable rod (70) is connected to said extremity (60*b*) and assumes a function of recall spring.

14. A movement for a music box according to claim 1, wherein said support means comprises a machined element (90) consisting of a base plate (91) and a support block (92) for said detent stop, said base plate is provided with a notch (94) which engages a bearing surface of one screw attaching said music keyboard to said support, and a pin (93) engages with an opening formed in said base plate.

15. A movement for a music box according to claim 14, wherein said support block (92) comprises means for positioning various types of detent stops to stop movement of said roller (13).

* * * * *